US009340995B2

(12) United States Patent
Jin

(10) Patent No.: US 9,340,995 B2
(45) Date of Patent: May 17, 2016

(54) EAVE STRUCTURE FOR A FOLDABLE TENT

(71) Applicant: Ki Ho Jin, Xiamen (CN)

(72) Inventor: Ki Ho Jin, Xiamen (CN)

( * ) Notice: Subject to any disclaimer, the term of this patent is extended or adjusted under 35 U.S.C. 154(b) by 0 days.

(21) Appl. No.: 13/909,256

(22) Filed: Jun. 4, 2013

(65) Prior Publication Data

US 2014/0202512 A1 Jul. 24, 2014

(30) Foreign Application Priority Data

Jan. 18, 2013 (CN) ..... 2013 2 0027238 U

(51) Int. Cl.
*E04H 15/64* (2006.01)
*E04H 15/46* (2006.01)
*E04H 15/16* (2006.01)

(52) U.S. Cl.
CPC ..... *E04H 15/646* (2013.01); *E04H 15/46* (2013.01); *E04H 15/16* (2013.01)

(58) Field of Classification Search
CPC .. A45B 19/06; A45B 2019/001; E04H 15/16; E04H 15/46; E04H 15/646; E04H 15/28
USPC ..... 135/114, 119, 120.2, 120.3, 125, 135, 135/136, 147, 139–142, 25.1, 26, 33.5, 75, 135/93, 94, 907
See application file for complete search history.

(56) References Cited

U.S. PATENT DOCUMENTS 1,623,154 A * 4/1927 Abercrombie ..... 135/123
1,707,960 A * 4/1929 Gilkison ..... 135/123
2,928,403 A * 3/1960 Hoskins ..... 135/142
3,388,712 A * 6/1968 Taylor ..... 135/98
3,461,890 A * 8/1969 Goodrich ..... 135/123
3,670,747 A * 6/1972 Pohl ..... E04H 15/00 135/156
3,690,334 A * 9/1972 Miller ..... 135/123
4,068,673 A * 1/1978 Bernardi ..... 160/22
4,259,974 A * 4/1981 de Polo ..... 135/24
4,265,261 A * 5/1981 Barker ..... 135/100
4,709,718 A * 12/1987 Nichols ..... 135/125
4,819,680 A * 4/1989 Beavers ..... 135/125
5,490,532 A * 2/1996 Mallookis et al. ..... 135/117
5,871,026 A * 2/1999 Lin ..... 135/98
6,357,461 B1 * 3/2002 Chai et al. ..... 135/88.09
6,868,858 B2 * 3/2005 Suh ..... 135/145
6,899,112 B2 * 5/2005 Tsai ..... 135/131
7,401,618 B2 * 7/2008 Caldwell ..... 135/33.7
2012/0125389 A1 * 5/2012 Vaughn et al. ..... 135/94

OTHER PUBLICATIONS

Canada Intellectual Property Office, Examiner's Report in Canada App. No. 2,820,560, Aug. 12, 2014 (2 pages).

* cited by examiner

*Primary Examiner* — Noah Chandler Hawk
(74) *Attorney, Agent, or Firm* — John H. Choi

(57) ABSTRACT

A retractable eave structure of a foldable tent includes a pole assembly having a first end and an opposing second end. The pole assembly first end is pivotally coupled to a hub for pivotal movement between an open state and a folded state of the foldable tent. The pole assembly is retractable such that a length between the first and second ends is adjustable between the open and folded states of the foldable tent. An eave portion of the foldable tent is constructed of tent fabric and fixedly attached to and extends from a main portion of the foldable tent. The eave portion includes an outer perimeter having a housing portion. The outer end of the pole assembly is fixed within the housing portion such that in the open state the pole assembly is extended and the eave portion is substantially taut.

9 Claims, 6 Drawing Sheets

EAVE STRUCTURE FOR A FOLDABLE TENT

CROSS REFERENCE TO RELATED APPLICATION

This application claims priority to China Patent Application No. 201320027238.4, filed Jan. 18, 2013, which is incorporated by reference in its entirety.

BACKGROUND OF THE INVENTION

The present invention relates in general to foldable or instant tents, and more particularly to a retractable pole assembly for a foldable tent.

Foldable tents are known in the art and have become very popular in recent years. In fact, every major retail outlet sells a foldable tent or instant tent in one form or another. In general, foldable tents comprise a tent fabric coupled to a collapsible frame assembly, pre-assembled, at a radially inner space of the erected frame assembly so that the tent fabric and frame assembly could be collectively opened and folded. However, foldable tents are manufactured in different configurations with a variety of features. Improvements of existing features continue to be made and new features are being developed as well.

More recently, whether an instant tent or a traditional assemble-to-use tent, providing sufficient ventilation within tents has become a requirement for the consumer. This is accomplished by providing a permeable material around a roof portion of the cabin portion of the tent and covering the permeable portion with a separate rain fly. It is also beneficial to have the rain fly cover windows and doors of the tent to provide the tent with additional protection from water leakage. For instant tents, this additional step of covering the cabin portion of the tent with a rain fly defeats the meaning of an "instant tent." Often times applying the rain fly requires more than one person and is time consuming as the users must also manually secure the rain fly to a bottom portion of the tent or to a ground surface.

In order to eliminate the need of a separate rain fly on instant tents, the present inventor developed an instant tent with an integrated rain fly, described in U.S. Patent Application Publication No. 2012/0055525A1 (application Ser. No. 13/295,396, filed Nov. 14, 2011) ("the '396 application), which is incorporated herein by reference. The instant tent with integrated rain fly allows the user to simply open the tent for use and fold the tent for storage without having to assemble and disassemble a separate rain fly. This is accomplished by providing collapsible eave or awning structures above the permeable portions of the cabin portion of the tent.

Each collapsible eave structure includes an eave pole extending from a hub and a tent fabric or eave portion extending from the cabin portion of the tent. The eave portion is attached to the eave pole by attachment means extending from the eave portion including at an outer end of the eave pole. One problem encountered with this collapsible eave structure is that the eave portion could become loose or flimsy which could cause rain water to accumulate thereon. Another problem associated with the collapsible eave structure is that a great deal of stress is concentrated on the end of the eave portion where a seam is formed for the hook attachment. These stresses could be caused either when the tent is in the open configuration or when the tent is folded.

OBJECTS AND SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

The present invention is intended to overcome at least the above-described disadvantages and to provide additional advantages to foldable tents with integrated rain flies. The present invention provides a well ventilated instant tent with integrated rain flies that is easily opened and folded. In the open state, the rain fly or eave portion is taut to ensure that water or debris is not collected on the eave portion. A housing portion or pocket is provided at the ends of the eave portion for coupling to an eave pole. The housing portion reduces the stresses caused by the eave pole. The eave pole is also retractable so that when the tent is folded stresses to the eave portion is reduced.

Facilitating the above-mentioned objectives, the subject invention provides an eave structure of a foldable tent comprising: a pole assembly comprising a first end and an opposing second end, said first end pivotally coupled to a hub for pivotal movement between an open state and a folded state of the foldable tent, the pole assembly being retractable such that a length between the first and second ends is adjustable between the open and folded states of the foldable tent; an eave portion of the foldable tent, the eave portion being constructed of tent fabric and fixedly attached to and extending from a main portion of the foldable tent, the eave portion having an outer perimeter comprising a housing portion, the outer end of the pole assembly fixed within the housing portion; wherein in the open state the pole assembly is extended such that the eave portion is substantially taut.

In one embodiment, the eave structure includes a retractable pole assembly comprising: a pole section having an inner end and an opposing outer end, said inner end pivotally coupled to a hub for pivotal movement between an open state and a folded state of the foldable tent; a biasing member having an inner end and an opposing outer end, the biasing member inner end engaging the pole section outer end and extending therefrom in a substantially aligned configuration along a longitudinal axis; and a sleeve having an inner end and an opposing outer end, the sleeve circumscribing the pole section outer end and biasing member along the longitudinal axis, the sleeve inner end being slidable along the pole section outer end, the biasing member outer end engaging the sleeve outer end such that the entire biasing member is positioned within the sleeve; wherein the tent fabric comprises a housing portion, the sleeve outer end being positioned within the housing portion such that in the open state the sleeve is extended and the biasing member is compressed, and the tent fabric is substantially taut.

In another embodiment, the eave structure includes a retractable pole assembly comprising: a pole having an inner section slidably coupled to an outer section, an inner end of the inner section pivotally coupled to a hub for pivotal movement between an open state and a folded state of the foldable tent, an outer end of the inner section having a first locking member, an inner end of the outer section having a second locking member engageable with the first locking member, an outer end of the outer section positioned within a housing portion of the eave portion of the foldable tent; wherein in the open state the first and second locking members are lockably engaged and the outer section is extended from the inner section such that the eave portion is substantially taut, and wherein in the folded state the first and second locking members are disengaged and the outer section is retracted within the inner section such that the eave portion is less taut.

BRIEF DESCRIPTION OF THE DRAWINGS

The foregoing summary, as well as the following detailed description of presently preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

Figure 1:
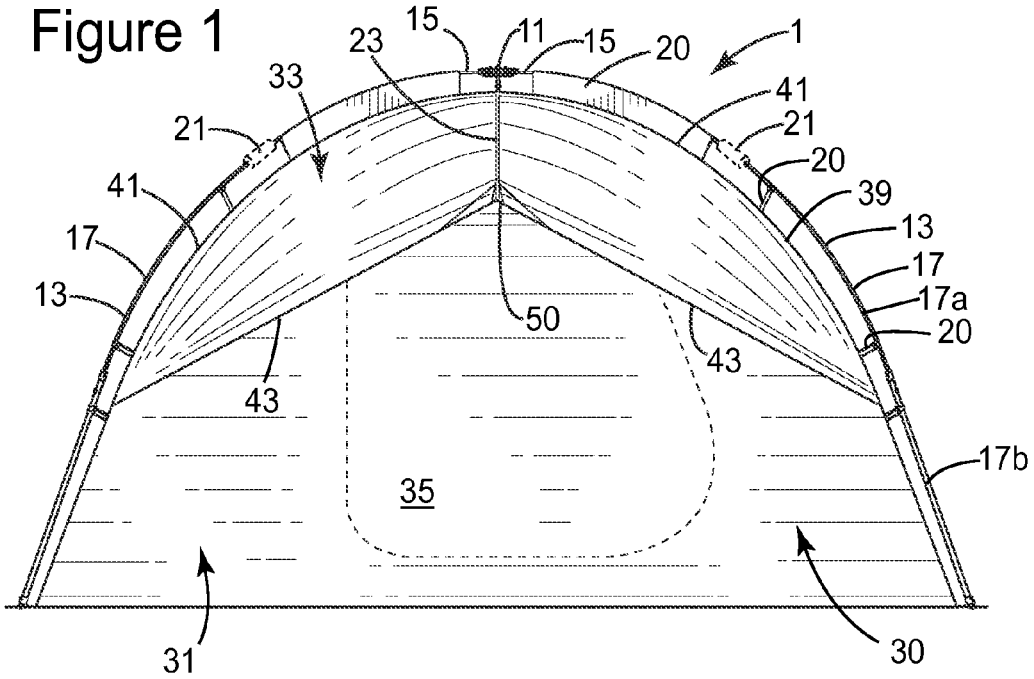
FIG. 1 is a front view of an embodiment of a foldable tent of the present invention in an open configuration.

To facilitate an understanding of the invention, identical reference numerals have been used, when appropriate, to designate the same or similar elements that are common to the figures. Further, unless stated otherwise, the features shown in the figures are not drawn to scale, but are shown for illustrative purposes only.

DETAILED DESCRIPTION OF THE INVENTION

Certain terminology is used in the following description for convenience only and is not limiting. The article "a" is intended to include one or more items, and where only one item is intended the term "one" or similar language is used. Additionally, to assist in the description of the present invention, words such as top, bottom, upper, lower, front, rear, inner, outer, right and left are used to describe the accompanying figures. The terminology includes the words above specifically mentioned, derivatives thereof, and words of similar import.

Figure 4:
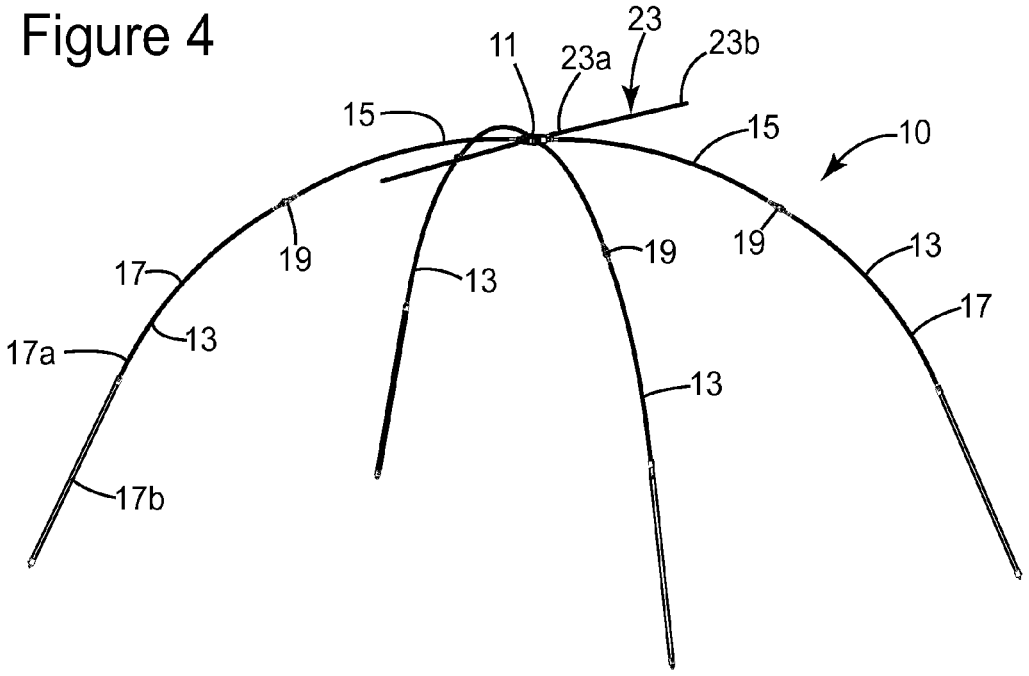
FIG. 4 is a perspective view of a frame assembly of the foldable tent shown in FIG. 1.
Figure 5:
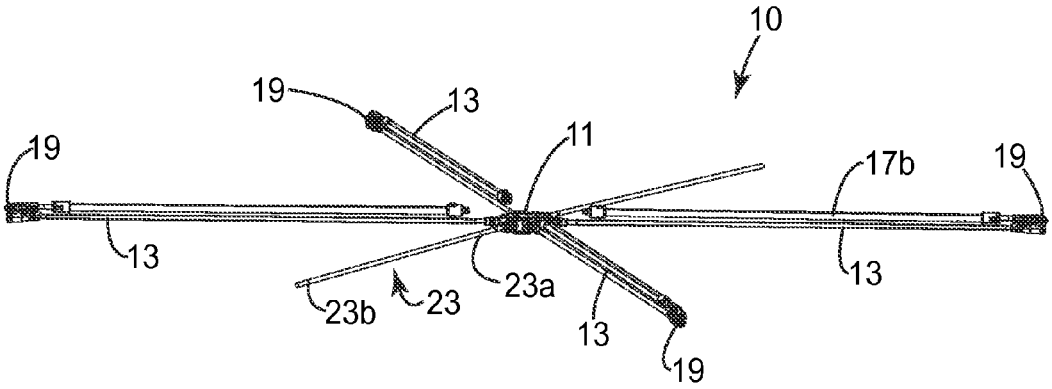
FIG. 5 is a perspective view of the frame assembly shown in FIG. 4 in a partially folded state.
Figure 6:
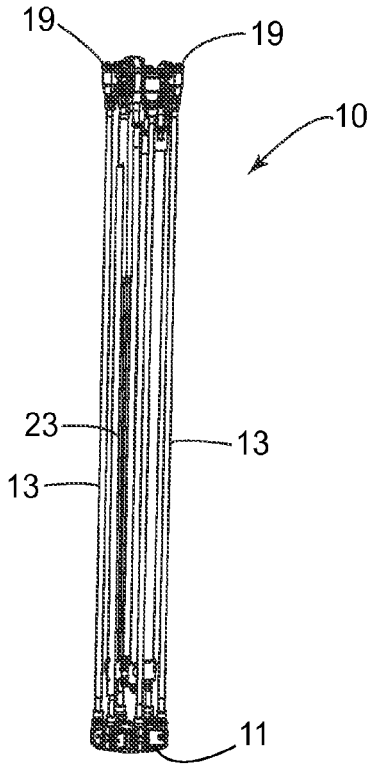
FIG. 6 is a perspective view of the frame assembly shown in FIG. 4 in a fully folded state.

Referring to FIGS. 1-6, a foldable or instant tent 1 of the present invention is shown. The foldable tent 1 is similar to that shown and described in the '396 application with several improvements, which are described in detail below. In general, the foldable tent 1 includes a frame assembly 10 and a tent fabric 30 slidably attached thereto via a plurality of attachment means 20, preferably by hooks and sleeves. The foldable tent 1 is opened or erected to an open state as shown in FIGS. 1-4, and folded or collapsed to a collapsed state as shown in FIG. 6, without requiring assembly or disassembly of any parts (i.e., the frame assembly 10 and tent fabric 30 are factory pre-assembled).

Figure 3:
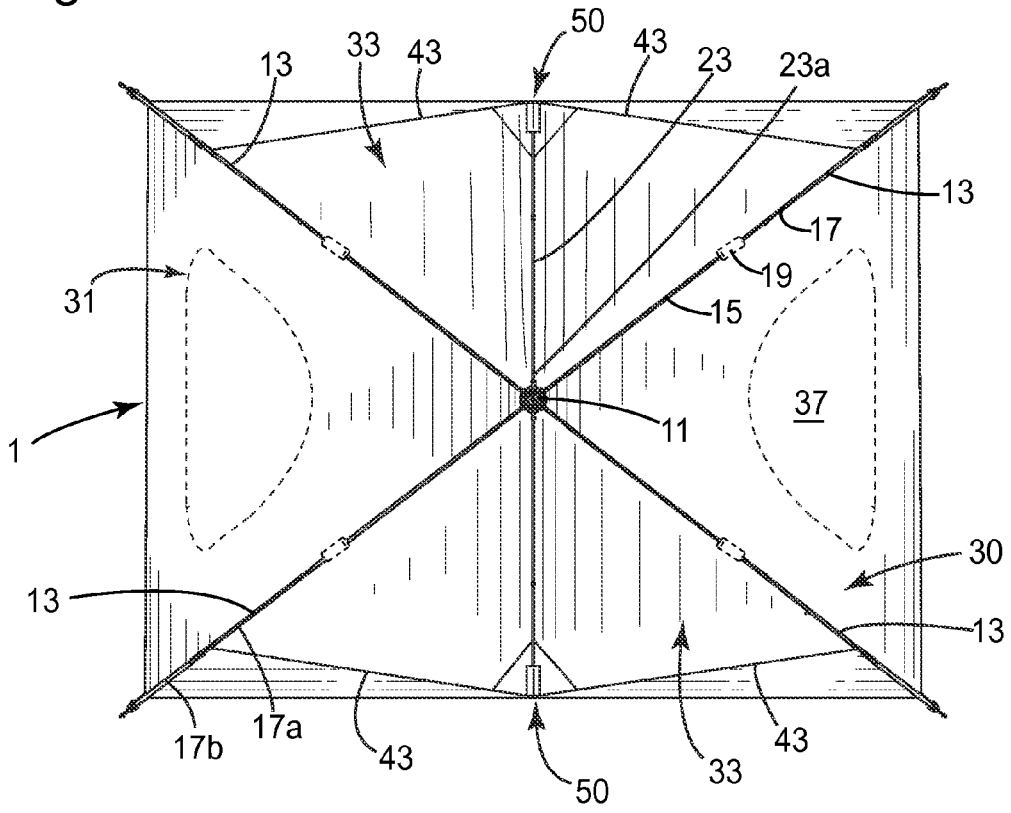
FIG. 3 is a plan view of the foldable tent shown in FIG. 1.

Referring to FIGS. 4-6, the frame assembly includes a hub 11 which centrally supports the tent 1. A plurality of main poles 13 are pivotally attached to the hub 11. In this embodiment, there are four main poles but the tent 1 could be constructed with anywhere from three to an unlimited number of main poles. Each main pole 13 includes a roof pole 15 which is pivotally connected to a side pole 17 by a pivoting joint 19. It is preferred that the pivoting joints 19 are covered by fabric joint covers 21 to protect the tent fabric 30 from wear and tear during the folding process and transport. Each side pole 17 includes an upper section 17*a* which is telescopically coupled with a lower section 17*b*. However, the upper and lower sections 17*a*, 17*b* could be pivotally coupled together as well. A plurality of eave poles 23 also extend from the hub 11, specifically, an inner end 23*a* is pivotally coupled to the hub 11 while an outer end 23*b* is free. Each eave pole 23 extends radially outward at a length substantially equal to the width of the tent 1, as shown in FIG. 3, to ensure that any windows or doors are sufficiently covered. In this embodiment, two eave poles are present but more or less eave poles could extend from the hub 11. Furthermore, the length of each eave pole 23 could vary without departing from the spirit and scope of the invention. A variety of materials such as metal tubing, composite tubing (tubing made of resin impregnated fibers) or solid composite poles may be used. For instant dome tents, the roof poles 15, side pole upper sections 17*a* and eave poles 23 are preferably flexible fiberglass reinforced plastic, and the side pole lower sections 17*b* are preferably metal tubing to form an overall round tent. For instant cabin tents, the roof poles 15, side poles 17 and eave poles 23 are preferably metal tubing to form a more cabin-like tent. However, different combinations of materials could be used for different sections of the frame assembly depending on the desired overall configuration of the tent. Furthermore, each of the poles 15, 17, 23 could be provided with multiple sections joined together depending on the desired height and width of the tent in its open and collapsed states.

Figure 2:
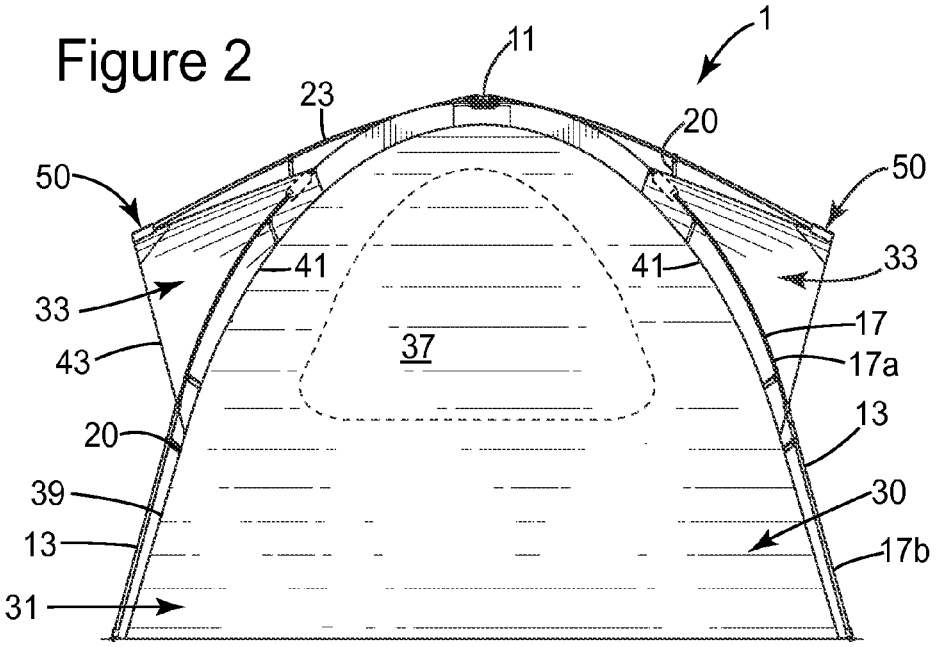
FIG. 2 is a side view of the foldable tent shown in FIG. 1.

Referring to FIGS. 1-3, the tent fabric 30 includes a cabin or main portion 31 and an eave portion 33. In this embodiment, the cabin portion 31 includes four sides and a floor joined together, preferably by conventional sewing methods, forming an enclosure for an inside dwelling space. Thus, seams 39 are formed along adjoining borders of the sides and floor. As shown in the drawings, each side includes doors 35 and windows 37, and could include other desired features such as floor vents and electrical access ports. Opposing top portions of the cabin portion sides where the eave portions 33 are located include a permeable fabric (not shown) such as mesh to improve ventilation for the tent interior while also protecting the interior from bugs and debris. One of ordinary skill in the art will recognize that a permeable fabric can be added to any number of sides of the tent and also take on different shapes and sizes without departing from the scope of the invention. For example, a permeable section can be included on all sides of the tent fabric provided that additional eave portions are included on those sides.

Referring again to FIGS. 1-3, the eave portion 33 is preferably constructed of the same material as the tent fabric of the cabin portion 31 but could be constructed of material with higher denier and additional water-resistant substances such as polyurethane coating. In this embodiment, each eave portion 33 includes a perimeter having four edges. Two inner edges 41 are sewn into corresponding seams 39 of the cabin portion 31 such that inner ends of the inner edges 41 culminate at the center of the cabin portion 31. Two outer edges 43 are free and are joined at inner ends at a position substantially aligned with the eave pole 23. Thus, a peak is formed on the eave portion 33 directly below the eave pole 23 to provide a decline on each side of the eave portion 33 to eliminate the possibility of water or debris accumulating on top of the eave portion 33.

Figure 12:
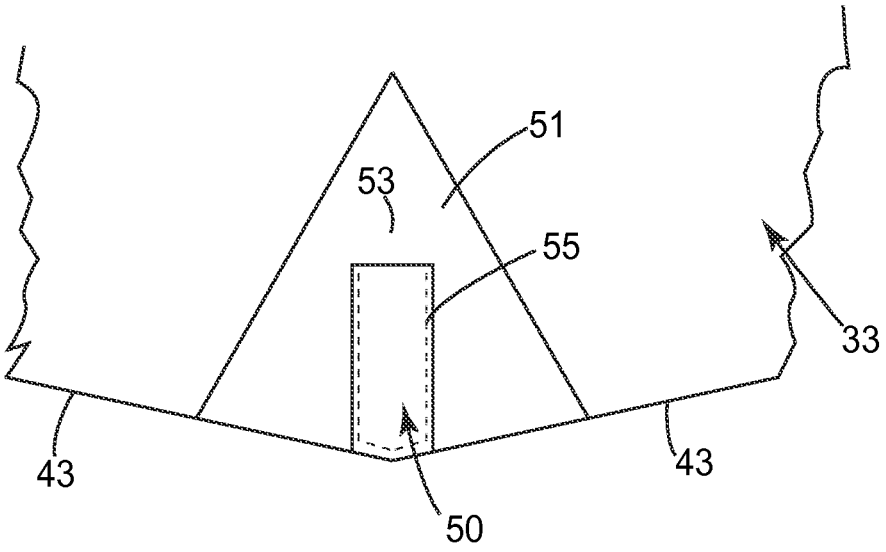
FIG. 12 is a plan view of a housing portion of an eave or awning portion of the present invention.

Referring to FIG. 12, the portion of the eave portion 33 where the inner ends of the two outer edges 43 are joined includes a reinforcing material 51 sewn into the fabric of the eave portion 33. The reinforcing material 51 is preferably constructed of nylon but could also be constructed of the same material as the eave portion 33. A housing portion or pocket 50 (or sleeve retaining member) 50 constructed of a rectangular fabric is sewn into the reinforcing material 51 and the eave portion 33 underneath on three of four edges, leaving an opening 53 on an inner end thereof. Thus, a space is provided between a bottom surface of the housing portion 50 and a top surface of the reinforcing material 51. The reinforcing material 51 provides additional support for seams 55 formed from sewing the housing portion 50 to the eave portion 33 and further protects the eave portion 33 from wear and tear from constant contact with the eave pole 23. The housing portion 50 is preferably constructed of nylon webbing with a water resistant coating but could be constructed of other tough, durable materials. In the preferred embodiment, the reinforcing material 51 is triangular and the housing portion 50 is rectangular but both components could take on other shapes and sizes without departing from the spirit and scope of the invention. Referring to FIGS. 1-3, outer ends of the eave poles 23 are housed within the housing portion 50 such that in the open state the eave portion 33 is substantially taut.

Referring to FIGS. 1-6, in operation, the tent 1 is erected by pivoting each of the roof poles 15 and eave poles 23 radially outward from the hub 11. The side poles 17 are unfolded and the lower side pole 17*b* is extended from the upper side pole 17*a* and locked in alignment. With the frame assembly 10 fully erected, the tent fabric 30 is substantially taut while tension from the tent fabric 30 provides a radially inward force on the frame assembly 10 to maintain the tent 1 in the open state. The tent 1 is folded in reverse order as shown in FIGS. 5 and 6, which is shown with only the frame assembly 10 to clearly show the folding process.

Referring again to FIGS. 1-6, each eave pole 23 is coupled to the housing portion 50 of the eave portion 33 in the open and folded states and with this configuration a substantial amount of stress is exerted on the eave poles 33 as well as the housing portions 50. Especially in the folded state, because the eave poles 23 are folded upward the eave portion 33 makes contact with a bottom or side portion of the hub 11 and the eave portion 33 is stretched further, causing additional tension on the eave portion 33 and the eave pole 23. Also, the eave portion 33 must be manufactured with precision in order to have the eave portion 33 taut in the open state. That is, the length of the eave portion 33 from the tent center to the outer end of the housing portion 50 must be precise so that the eave portion 33 is sufficiently taut while the eave pole 23 is not over stressed. This is could be difficult to do on a consistent basis because of inevitable human error during the manufacturing process. To alleviate these concerns the eave poles 23 are constructed with retractable pole assemblies at the eave pole outer end 23*b*, as shown in the various embodiments in FIGS. 7-11.

Figure 7:
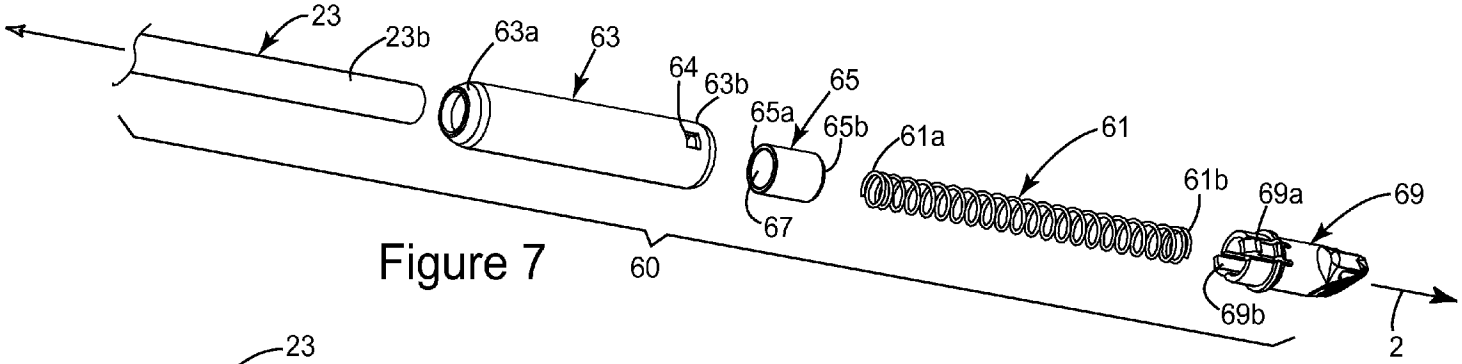
FIG. 7 is an exploded view of a first embodiment a retractable pole assembly of the present invention.

Referring to FIG. 7, a first embodiment of a retractable pole assembly 60 of the present invention is shown. The pole assembly 60 includes a biasing member 61, preferably a torsion spring, having an inner end 61*a* and an opposing outer end 61*b*. The biasing member 61 extends in a substantially aligned configuration with the eave pole outer end 23*b* along a longitudinal axis 2. A sleeve 63, having an open inner end 63*a* and an opposing open outer end 63*b*, circumscribes the eave pole outer end 23*b* and biasing member 61 along the longitudinal axis 2. The inner diameter of the sleeve inner end 63*a* is sized such that the sleeve inner end 63*a* is slidable along the eave pole outer end 23*b*. The sleeve 63 includes a coupling engagement means 64, preferably a slot extending through a side wall proximate the outer end 63*b*. A pole retaining member 65 is disposed within the sleeve 63 between the eave pole outer end 23*b* and the biasing member inner end 61*a*. In this embodiment, the pole retaining member 65 is cylindrical and includes a channel 67 extending between inner and outer ends 65*a*, 65*b*. The inner end 65*a* is open and the outer end 65*b* is enclosed such that the eave pole outer end 23*b* is disposed within the channel 67 and engaged with an inner surface (not shown) of the pole retaining member outer end 65*b*. The diameter of the pole retaining member inner end 65*a* is greater than the diameter of the sleeve inner end 63*a* so that the pole retaining member 65 is prevented from movement beyond the sleeve inner end 63*a*. The biasing member inner end 61*a* is engaged with an outer surface (not shown) of the pole retaining member outer end 65*b*. The retractable pole assembly further includes a spring retaining member 69 having a locking member 69*a*, preferably a detent, disposed on a side portion. The detent 69*a* is lockably engaged with the slot 64 to secure the biasing member 61 within the sleeve 63. The spring retaining member 69 further includes a hook portion 69*b* extending toward and securing the biasing member 61. Thus, the entire biasing member 61 is positioned within the sleeve 63. In this embodiment, the diameter of the biasing member 61 need not be smaller than the diameter of the eave pole 23. Instead, it is sufficient for the inner diameter of the biasing member 61 be less than the outer diameter of the pole retaining member 65. Fully assembled, an outer end of the pole assembly 60 is secured within the housing 50. In the tent's 1 open state the biasing member 61 is compressed and generates sufficient tension along the longitudinal axis 2 to provide a taut eave portion 33. In the tent's 1 folded state, the biasing member 61 is more compressed to accommodate for the lost length in the eave portion 33 from contacting the hub 11.

Figure 8:
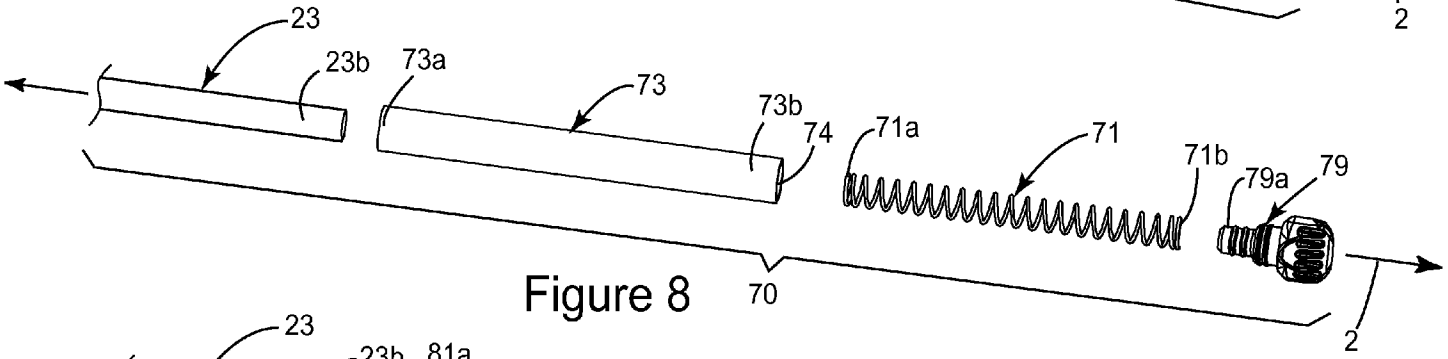
FIG. 8 is an exploded view of a second embodiment a retractable pole assembly of the present invention.

Referring to FIG. 8, a second embodiment of a retractable pole assembly 70 of the present invention is shown. The pole assembly 70 includes a biasing member 71, preferably a torsion spring, having an inner end 71*a* and an opposing outer end 71*b*. The inner diameter of the biasing member 71 is equal to or less than the diameter of the eave pole outer end 23*b*. The biasing member inner end 71*a* engages the eave pole outer end 23*b* and extends in a substantially aligned configuration with the eave pole outer end 23*b* along a longitudinal axis 2. A hollow cylindrical sleeve 73, having an open inner end 73*a* and an opposing open outer end 73*b*, circumscribes the eave pole outer end 23*b* and biasing member 71 along the longitudinal axis 2. The sleeve 73 is sized such that it is slidable along the eave pole outer end 23*b*. The sleeve 73 includes a coupling engagement means 74, preferably a female thread disposed on an inner wall (not shown) of the sleeve outer end 73*b*. The retractable pole assembly 70 further includes a spring retaining member 79 having a locking member 79*a*, preferably a male thread, disposed on and inner end of the spring retaining member 79. The male thread 79*a* is lockably engaged with the female thread of the sleeve outer end 73*b* to secure the biasing member 71 within the sleeve 73. When fully assembled, in the pole assembly's 70 elongated state (i.e., the tent's 1 open state), the biasing member 71 is compressed from its non-compressed rested state, and in the pole assembly's 70 retracted state (i.e., the tent's 1 folded state), the biasing member 71 is more compressed.

Figure 9:
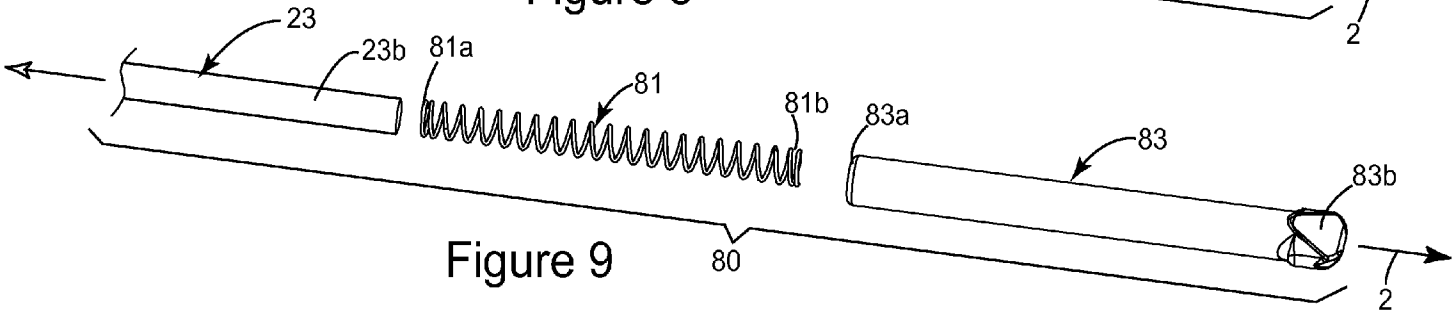
FIG. 9 is an exploded view of a third embodiment a retractable pole assembly of the present invention.

Referring to FIG. 9, a third embodiment of a retractable pole assembly 80 of the present invention is shown. The pole assembly 80 includes a biasing member 81, preferably a torsion spring, having an inner end 81*a* and an opposing outer end 81*b*. The inner diameter of the biasing member 81 is equal to or less than the diameter of the eave pole outer end 23*b*. The biasing member inner end 81*a* engages the eave pole outer end 23*b* and extends in a substantially aligned configuration with the eave pole outer end 23*b* along a longitudinal axis 2. A hollow cylindrical sleeve 83, having an open inner end 83*a* and an opposing enclosed outer end 83*b*, circumscribes the eave pole outer end 23*b* and biasing member 81 along the longitudinal axis 2. The sleeve inner end 83*a* is sized such that it is slidable along the eave pole outer end 23*b*. The enclosed outer end 83*b* could be integrally molded with the sleeve 83 but could also be a separate attachment coupled to the outer end 83*b* by attachment means such as those described above with respect to the first and second embodiments 60, 70. The biasing member outer end 81*b* is engaged with an inner surface (not shown) of the sleeve outer end 83*b*, which could include an internal locking member to secure the biasing member outer end 81*b* to the inner surface. When fully assembled, in the pole assembly's 80 elongated state (i.e., the tent's 1 open state), the biasing member 81 is compressed from its non-compressed rested state, and in the pole assembly's 80 retracted state (i.e., the tent's 1 folded state), the biasing member 81 is more compressed.

Figure 10:
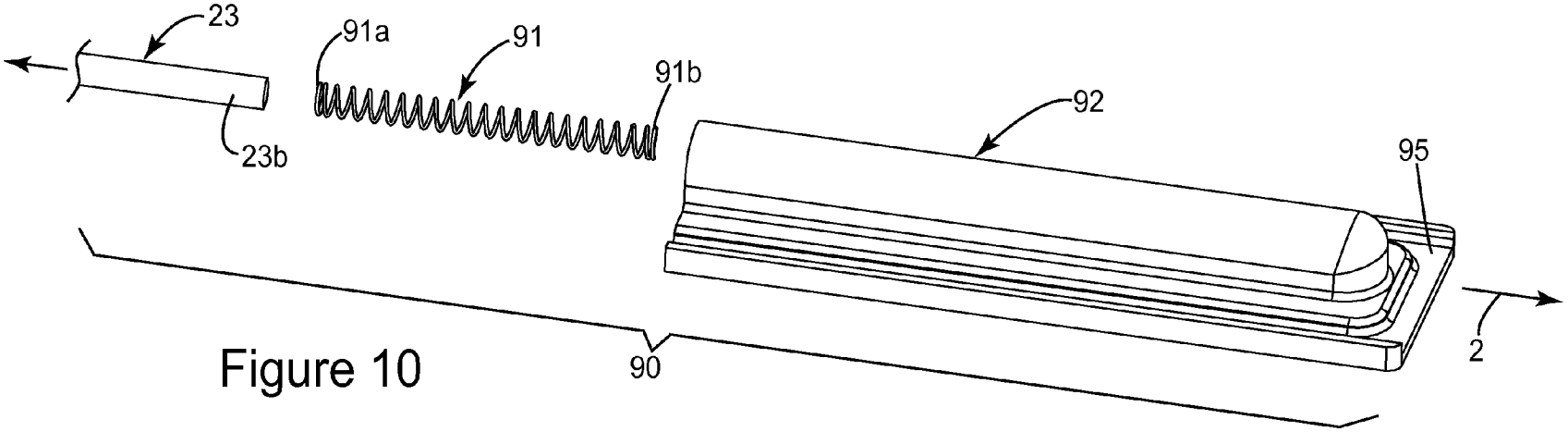
FIG. 10 is an exploded view of a fourth embodiment a retractable pole assembly of the present invention.

Referring to FIG. 10, a fourth embodiment of a retractable pole assembly 90 of the present invention is shown. In this embodiment, a substantially rigid housing portion 92 is formed integral to the eave portion 33. An inner portion (not shown) of the housing portion 92 includes an integrally formed cylindrically shaped hollow sleeve (not shown) having a channel extending along a longitudinal axis 2. The sleeve is shaped and sized such that a biasing member 91, preferably a torsion spring, having an inner end 91*a* and an opposing outer end 91*b*, fits within. The biasing member outer end 91*b* is engaged with an inner surface of the sleeve outer end (not shown), which could include an internal locking member to secure the biasing member outer end 91*b* to the inner surface. The inner diameter of the biasing member 91 is equal to or less than the diameter of the eave pole outer end 23*b*. The biasing member inner end 91*a* engages the eave pole outer end 23*b* and extends in a substantially aligned configuration with the eave pole outer end 23*b* along the longitudinal axis 2 so that the biasing member 91 and eave pole outer end 23*b* are housed within the sleeve. The housing portion 92 further includes an integral base member 95 along a bottom portion thereof for further support. A bottom surface of the base member 95 is preferably coupled to the eave portion 33 by adhesive but other methods could be used. For example, the base member 95 be attached to the eave portion 33 by heat welding or by conventional sewing methods. It is preferred that the housing portion 92 (i.e., sleeve and base member 95) is integrally constructed of a hard molded plastic to reduce manufacturing cost and to minimize the weight of the retractable pole assembly 90 but other materials could be used without departing from the spirit and scope of the invention. When fully assembled, in the pole assembly's 90 elongated state (i.e., the tent's 1 open state), the biasing member 91 is compressed from its non-compressed rested state, and in the pole assembly's 90 retracted state (i.e., the tent's 1 folded state), the biasing member 91 is more compressed.

The biasing members in the first through fourth embodiments are preferably a torsion spring constructed of metal capable of withstanding substantial wear and tear from continuous compression and de-compression. The torsion spring is preferably flexible yet durable so that in the open state sufficient tension is generated to provide a taut eave portion and in the folded state excessive tension is avoided on the eave portion and the eave pole. However, other biasing mechanisms such as pneumatic devices and spring clips could be used as well. It is also preferred that the other components of the retractable pole assembly (i.e., the sleeve, the pole retaining member and the spring retaining member) be constructed of a hard molded plastic to reduce manufacturing cost and to minimize weight but other materials could be used without departing from the spirit and scope of the invention. Furthermore, even though it is preferred that the sleeves are substantially cylindrical in shape, other shapes could be utilized so long as the inner portion of the sleeves are capable of housing the inner components without interfering with their movement. Furthermore, each sleeve has a length sufficient to house the eave pole outer ends in the open and folded states of the tent.

Figure 11:
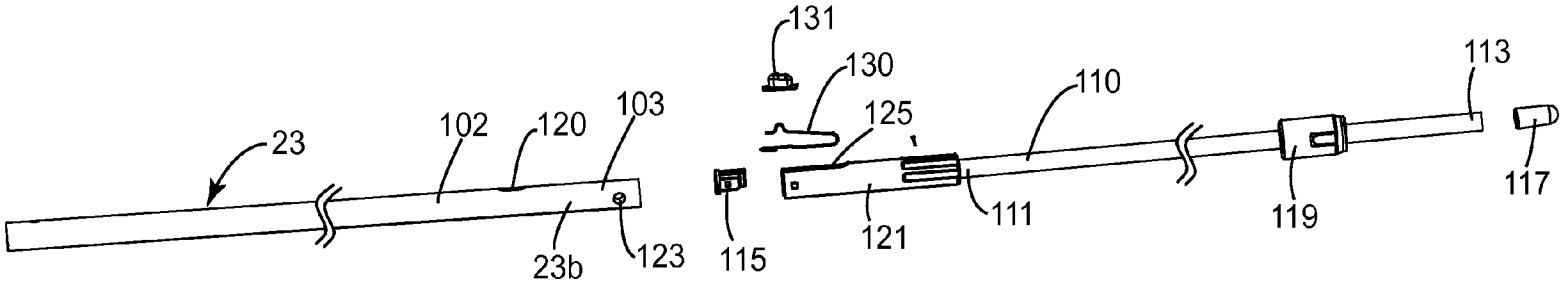
FIG. 11 is an exploded view of a fifth embodiment a retractable pole assembly of the present invention.

Referring to FIG. 11, a fifth embodiment of a retractable pole assembly 100 of the present invention is shown. In this embodiment, the eave pole 23 is constructed of tubular steel and includes an inner section 102 slidably coupled to an outer section 110. That is, the outer section 110 is slidable within the inner section 102. An outer end of the inner section 103 includes a first locking member 120 and an inner end of the outer section 111 includes a second locking member 130 engageable with the first locking member 120. In this embodiment, the first locking member 120 is a hole extending through a side of the inner section 102 and the second locking member 130 is a spring clip housed within the outer section inner end 111. The spring clip 130 includes a plastic engaging button 131. An upper portion of the spring clip and engaging button 131 extend through an aperture (not shown) of the outer section inner end 111. The outer section inner end 111 is enclosed with a first cap or plug 115 which is fixed thereto and is also fixed to the spring clip 130 to maintain the spring clip 130 in a fixed position. A second cap or plug 117 is fixed to the outer section outer end 113. The second cap 117 is rounded at a free end so that friction is minimized on the eave portion housing portion 50. The outer section 110 is also provided with a stopper 119 which is fixed thereto so that the outer section 110 is prevented from retracting within the inner section 102 beyond the stopper 119. A protective sleeve 121 is fixed to the inner section outer end 103 and circumscribes the inner and outer sections 102, 110. Integral detents (not shown) extend from an inner surface of the sleeve 121 and lock into corresponding apertures 123 of the inner section outer end 103. A top portion of the protective sleeve is provided with an opening 125 which is positioned over the first locking member 120. The protective sleeve 121 eliminates any exposed metal edges to provide a safe product for the user. The outer section 110 is extended and locked to the inner section 102 when the tent 1 is in the open state so that the eave portion 33 is substantially taut. The inner and outer sections 102, 110 are unlocked and the outer section 110 is retracted within the inner section 102 when the tent 1 is folded to alleviate stresses on the eave portion 33.

The embodiments shown in FIGS. 7-10 are best utilized for eave poles constructed of FRP or other solid cylindrical configurations and the embodiment shown in FIG. 11 is best utilized for eave poles constructed of hollow tubular steel. However, various modifications could be made to accommodate either type of pole for each of the embodiments.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

The invention claimed is:

1. An eave structure for a foldable tent comprising:

a tent fabric having a free end, the tent fabric extending from a main portion of the tent and suspended above said main portion when the tent is in an open state;

a pole section having an inner end and an opposing outer end, said inner end pivotally coupled to a hub for pivotal movement between the open state and a folded state of the foldable tent, the pole section being suspended above the main portion of the tent when the tent is in the open state;

a biasing member having an inner end and an opposing outer end, the biasing member inner end engaging the pole section outer end and extending therefrom in a substantially aligned configuration along a longitudinal axis; and a sleeve having an inner end and an opposing outer end, said outer end being a free end and being open to form an orifice extending along the longitudinal axis, said outer end having a first thread, the sleeve circumscribing the pole section outer end and biasing member along the longitudinal axis, the sleeve inner end being slidable along the pole section outer end, the biasing member outer end engaging the sleeve outer end;

wherein the entire biasing member is positioned within the sleeve in the open and folded states; and wherein the sleeve outer end is coupled to the tent fabric such that in the open state the sleeve is extended and the biasing member is compressed, and the tent fabric is substantially taut.

2. The eave structure of claim 1, further comprising a spring retaining member having a second thread, the second thread matching the first thread such that the first and second threads are fixedly engaged.

3. The eave structure of claim 2, wherein in the open state the sleeve is extended and the biasing member is compressed, and in the folded state the sleeve is retracted and the biasing member is more compressed.

4. An eave structure of a foldable tent comprising:

a pole section having an inner end and an opposing outer end, said inner end pivotally coupled to a hub for pivotal movement between an open state and a folded state of the foldable tent, said outer end having an outer surface, the pole section being suspended above a main portion of the tent when the tent is in the open state;

a biasing member having an inner end and an opposing outer end, the biasing member inner end engaging the outer surface of the pole section outer end;

a sleeve having an inner end and an opposing outer end, said outer end being a free end and being open to form an orifice extending along the longitudinal axis, said outer end having a first thread, the sleeve circumscribing the pole section outer end and the biasing member, the biasing member outer end engaging the sleeve outer end, the entire biasing member positioned between the outer surface of the pole section outer end and the sleeve outer end; and an eave portion of the foldable tent, the eave portion fixedly attached to and extending from the main portion of the tent and suspended above said main portion when the tent is in the open state, the sleeve outer end coupled to the eave portion;

wherein in the open state the sleeve is extended such that the eave portion is substantially taut.

5. The eave structure of claim 4, further comprising a spring retaining member having a second thread, the second thread matching the first thread such that the first and second threads are fixedly engaged.

6. The eave structure of claim 5, wherein in the open state the sleeve is extended and the biasing member is compressed, and in a folded state the sleeve is retracted and the biasing member is more compressed.

7. An eave structure for a foldable tent comprising:

a tent fabric having a free end with a sleeve retaining member, the tent fabric fixed attached to and extending from a main portion of the tent and suspended above said main portion when the tent is in an open state;

a pole section having an inner end and an opposing outer end, said inner end coupled to a hub for pivotal movement between the open state and a folded state, said outer end having an outer surface, the pole section being suspended above the main portion of the tent when the tent is in the open state;

a biasing member having an inner end and an opposing outer end, the biasing member inner end operably coupled with the outer surface of the pole section outer end;

a sleeve having an inner end and an opposing outer end, said outer end being a free end, the sleeve circumscribing the pole section outer end and biasing member, the sleeve outer end coupled to the sleeve retaining member; and a spring retaining member forming an enclosure on the sleeve outer end, wherein the sleeve outer end includes a first thread and an inner end of the spring retaining member includes a second thread such that the first and second threads are fixedly engaged.

8. The eave structure of claim 7, wherein the biasing member is compressed and at least a portion of the tent fabric is substantially taut in the open state and a folded state.

9. The eave structure of claim 8, wherein in the open state the sleeve is extended and the biasing member is compressed, and in the folded state the sleeve is retracted and the biasing member is more compressed.

* * * * *